US008292461B2

(12) United States Patent
Thornton et al.

(10) Patent No.: US 8,292,461 B2
(45) **Date of Patent: *Oct. 23, 2012**

(54) HEATSINK FOR COOLING AT LEAST ONE LED

(75) Inventors: Gerry Farrel Thornton, Littlestown, PA (US); Justin Mathew Walker, York, PA (US); Neil Ruberg, New Oxford, PA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/367,396

(22) Filed: Feb. 7, 2012

(65) Prior Publication Data

US 2012/0134145 A1 May 31, 2012

Related U.S. Application Data

(63) Continuation of application No. 12/467,062, filed on May 15, 2009, now Pat. No. 8,123,378.

(51) Int. Cl.
*F21S 4/00* (2006.01)
*F21V 21/00* (2006.01)

(52) U.S. Cl. ..... 362/249.02; 362/294; 362/311.02; 362/800

(58) Field of Classification Search ..... 362/249.02, 362/294, 311.02, 545, 800
See application file for complete search history.

(56) References Cited

U.S. PATENT DOCUMENTS 4,503,360 A 3/1985 Bedel
4,504,894 A 3/1985 Reibling
4,509,106 A 4/1985 Mayer
4,654,629 A 3/1987 Bezos
4,729,076 A 3/1988 Masami
4,734,835 A 3/1988 Vines
4,871,944 A 10/1989 Skwirut
4,943,900 A 7/1990 Gartner
4,954,822 A 9/1990 Borenstein
4,982,176 A 1/1991 Schwarz
4,999,749 A 3/1991 Dormand
5,010,452 A 4/1991 Krebser
5,075,833 A 12/1991 Dormand
5,136,287 A 8/1992 Borenstein
5,138,541 A 8/1992 Kano
5,142,460 A 8/1992 McAtee
5,154,509 A 10/1992 Wulfman
5,351,172 A 9/1994 Attree
5,375,043 A 12/1994 Tokunaga
5,388,357 A 2/1995 Malita
5,390,092 A 2/1995 Lin
5,426,574 A 6/1995 Carolfi
5,450,302 A 9/1995 Maase
5,463,280 A 10/1995 Johnson
5,537,301 A 7/1996 Martich
5,548,499 A 8/1996 Zadeh
5,575,459 A 11/1996 Anderson
5,580,163 A 12/1996 Johnson
5,607,227 A 3/1997 Yasumoto
5,655,830 A 8/1997 Ruskouski
5,688,042 A 11/1997 Madadi
5,726,535 A 3/1998 Yan
5,752,766 A 5/1998 Bailey
5,785,411 A 7/1998 Komai
5,785,418 A 7/1998 Hochstein
5,790,040 A 8/1998 Kreier (Continued)

*Primary Examiner* — Jason Moon Han
(74) *Attorney, Agent, or Firm* — Mark L. Beloborodov

(57) ABSTRACT

A heatsink for cooling at least one LED may have a longitudinally extending channel flanked on each side by a longitudinally extending column of heat fins.

10 Claims, 8 Drawing Sheets

U.S. PATENT DOCUMENTS

| | | | |
|---|---|---|---|
| 5,806,965 | A | 9/1998 | Deese |
| 5,810,463 | A | 9/1998 | Kawahara |
| 5,890,794 | A | 4/1999 | Abtahi |
| 5,918,970 | A | 7/1999 | Brohard |
| 5,949,347 | A | 9/1999 | Wu |
| 5,980,071 | A | 11/1999 | Hsieh |
| 5,993,027 | A | 11/1999 | Yamamoto |
| 6,068,383 | A | 5/2000 | Robertson |
| 6,068,384 | A | 5/2000 | Tyson |
| 6,154,362 | A | 11/2000 | Takahashi |
| 6,166,640 | A | 12/2000 | Nishihira |
| 6,183,114 | B1 | 2/2001 | Cook |
| 6,208,466 | B1 | 3/2001 | Liu |
| 6,220,722 | B1 | 4/2001 | Begemann |
| 6,250,774 | B1 | 6/2001 | Begemann |
| 6,271,532 | B1 | 8/2001 | Trokhan |
| 6,276,814 | B1 | 8/2001 | Gough |
| 6,305,109 | B1 | 10/2001 | Lee |
| 6,325,651 | B1 | 12/2001 | Nishihara |
| 6,331,915 | B1 | 12/2001 | Myers |
| 6,341,877 | B1 | 1/2002 | Chong |
| 6,350,043 | B1 | 2/2002 | Gloisten |
| 6,350,046 | B1 | 2/2002 | Lau |
| 6,357,893 | B1 | 3/2002 | Belliveau |
| 6,392,541 | B1 | 5/2002 | Bucher |
| 6,394,626 | B1 | 5/2002 | McColloch |
| 6,402,346 | B1 | 6/2002 | Liao |
| 6,431,728 | B1 | 8/2002 | Fredericks |
| 6,502,962 | B1 | 1/2003 | Menke |
| 6,517,222 | B1 | 2/2003 | Orlov |
| 6,520,655 | B2 | 2/2003 | Ohuchi |
| 6,540,372 | B2 | 4/2003 | Joseph |
| 6,573,536 | B1 | 6/2003 | Dry |
| 6,577,072 | B2 | 6/2003 | Saito |
| 6,583,550 | B2 | 6/2003 | Iwasa |
| 6,585,395 | B2 | 7/2003 | Luk |
| 6,632,006 | B1 | 10/2003 | Rippel |
| 6,666,567 | B1 | 12/2003 | Feldman |
| 6,678,168 | B2 | 1/2004 | Kenny |
| 6,705,751 | B1 | 3/2004 | Liu |
| 6,739,734 | B1 | 5/2004 | Hulgan |
| 6,762,562 | B2 | 7/2004 | Leong |
| 6,815,724 | B2 | 11/2004 | Dry |
| 6,860,628 | B2 | 3/2005 | Robertson |
| 6,871,983 | B2 | 3/2005 | Jacob |
| 6,932,495 | B2 | 8/2005 | Sloan |
| 6,936,968 | B2 | 8/2005 | Cross |
| 6,942,361 | B1 | 9/2005 | Kishimura |
| 6,948,840 | B2 | 9/2005 | Grenda |
| 6,955,440 | B2 | 10/2005 | Niskanen |
| 6,974,233 | B1 | 12/2005 | Aubrey |
| 6,979,105 | B2 | 12/2005 | Leysath |
| 6,994,452 | B2 | 2/2006 | Rozenberg |
| 6,997,583 | B2 | 2/2006 | Broelemann |
| 7,014,341 | B2 | 3/2006 | King |
| 7,021,787 | B1 | 4/2006 | Kuelbs |
| 7,034,470 | B2 | 4/2006 | Cok |
| 7,049,761 | B2 | 5/2006 | Timmermans |
| 7,053,557 | B2 | 5/2006 | Cross |
| 7,086,747 | B2 | 8/2006 | Nielson |
| 7,098,486 | B2 | 8/2006 | Chen |
| 7,101,056 | B2 | 9/2006 | Pare |
| 7,132,785 | B2 | 11/2006 | Ducharme |
| 7,137,727 | B2 | 11/2006 | Joseph |
| 7,178,952 | B2 | 2/2007 | Bucher |
| 7,186,002 | B2 | 3/2007 | Matthews |
| 7,207,690 | B2 | 4/2007 | Haugaard |
| 7,218,056 | B1 | 5/2007 | Harwood |
| 7,241,038 | B2 | 7/2007 | Naniwa |
| 7,249,865 | B2 | 7/2007 | Robertson |
| 7,252,409 | B2 | 8/2007 | Kim |
| 7,307,546 | B1 | 12/2007 | Partap |
| 7,329,031 | B2 | 2/2008 | Liaw |
| 7,438,441 | B2 | 10/2008 | Sun |
| 7,440,280 | B2 | 10/2008 | Shuy |
| 7,524,089 | B2 | 4/2009 | Park |
| 2002/0047516 | A1 | 4/2002 | Iwasa |
| 2002/0122309 | A1 | 9/2002 | Abdelhafez |
| 2002/0136010 | A1 | 9/2002 | Luk |
| 2002/0145878 | A1 | 10/2002 | Venegas |
| 2002/0176259 | A1 | 11/2002 | Ducharme |
| 2002/0181231 | A1 | 12/2002 | Luk |
| 2003/0021117 | A1 | 1/2003 | Chan |
| 2003/0052599 | A1 | 3/2003 | Sun |
| 2003/0102810 | A1 | 6/2003 | Cross |
| 2003/0137845 | A1 | 7/2003 | Leysath |
| 2004/0007980 | A1 | 1/2004 | Shibata |
| 2004/0062041 | A1 | 4/2004 | Cross |
| 2004/0080960 | A1 | 4/2004 | Wu |
| 2004/0107615 | A1 | 6/2004 | Pare |
| 2004/0109330 | A1 | 6/2004 | Pare |
| 2004/0120152 | A1 | 6/2004 | Bolta |
| 2004/0141326 | A1 | 7/2004 | Dry |
| 2005/0007024 | A1 | 1/2005 | Evans |
| 2005/0036322 | A1 | 2/2005 | Veffer |
| 2005/0073760 | A1 | 4/2005 | Kakiuchi |
| 2005/0146899 | A1 | 7/2005 | Joseph |
| 2005/0168986 | A1 | 8/2005 | Wegner |
| 2005/0201082 | A1 | 9/2005 | Mauk |
| 2005/0212397 | A1 | 9/2005 | Murazaki |
| 2005/0276053 | A1 | 12/2005 | Nortrup |
| 2006/0002106 | A1 | 1/2006 | Hong |
| 2006/0007682 | A1 | 1/2006 | Reiff |
| 2006/0050528 | A1 | 3/2006 | Lyons |
| 2006/0092638 | A1 | 5/2006 | Harwood |
| 2006/0109661 | A1 | 5/2006 | Coushaine |
| 2006/0164843 | A1 | 7/2006 | Adachi |
| 2006/0193139 | A1 | 8/2006 | Sun |
| 2006/0209545 | A1 | 9/2006 | Yu |
| 2006/0215408 | A1 | 9/2006 | Lee |
| 2006/0221606 | A1 | 10/2006 | Dowling |
| 2006/0291202 | A1 | 12/2006 | Kim |
| 2007/0030686 | A1 | 2/2007 | Haugaard |
| 2007/0053182 | A1 | 3/2007 | Robertson |
| 2007/0058358 | A1 | 3/2007 | Chikazawa |
| 2007/0076416 | A1 | 4/2007 | Leonhardt |
| 2007/0102033 | A1 | 5/2007 | Petroey |
| 2007/0114558 | A1 | 5/2007 | Lam |
| 2007/0115654 | A1 | 5/2007 | Ruben |
| 2007/0120135 | A1 | 5/2007 | Soules |
| 2007/0133202 | A1 | 6/2007 | Huang |
| 2007/0183156 | A1 | 8/2007 | Shan |
| 2007/0211470 | A1 | 9/2007 | Huang |
| 2007/0230172 | A1 | 10/2007 | Wang |
| 2007/0247853 | A1 | 10/2007 | Dorogi |
| 2007/0279909 | A1 | 12/2007 | Li |
| 2007/0285949 | A1 | 12/2007 | Lodhie |
| 2008/0007955 | A1 | 1/2008 | Li |
| 2008/0043472 | A1 | 2/2008 | Wang |
| 2008/0074869 | A1 | 3/2008 | Okishima |
| 2008/0080188 | A1 | 4/2008 | Wang |
| 2008/0084701 | A1 | 4/2008 | Van De Ven |
| 2008/0158887 | A1 | 7/2008 | Zhu |
| 2008/0165535 | A1 | 7/2008 | Mazzochette |
| 2008/0184475 | A1 | 8/2008 | Sladick |
| 2008/0205062 | A1 | 8/2008 | Dahm |
| 2008/0212333 | A1 | 9/2008 | Chen |
| 2008/0253124 | A1 | 10/2008 | Liao |
| 2008/0304269 | A1 | 12/2008 | Pickard |
| 2009/0040750 | A1 | 2/2009 | Myer |
| 2009/0072970 | A1 | 3/2009 | Barton |
| 2009/0080189 | A1 | 3/2009 | Wegner |
| 2009/0086476 | A1 | 4/2009 | Tickner |
| 2009/0086481 | A1 | 4/2009 | Wegner |
| 2009/0303717 | A1 | 12/2009 | Long |

HEATSINK FOR COOLING AT LEAST ONE LED

CROSS-REFERENCE TO RELATED DOCUMENTS

This application claims priority to and is a continuation under 35 U.S.C. §120 of pending patent application Ser. No. 12/467,062 filed May 15, 2009.

TECHNICAL FIELD

This invention pertains to a heatsink for cooling at least one LED.

BRIEF DESCRIPTION OF THE ILLUSTRATIONS

Embodiments of the invention are illustrated in the following Figures.

DETAILED DESCRIPTION

Figure 1:
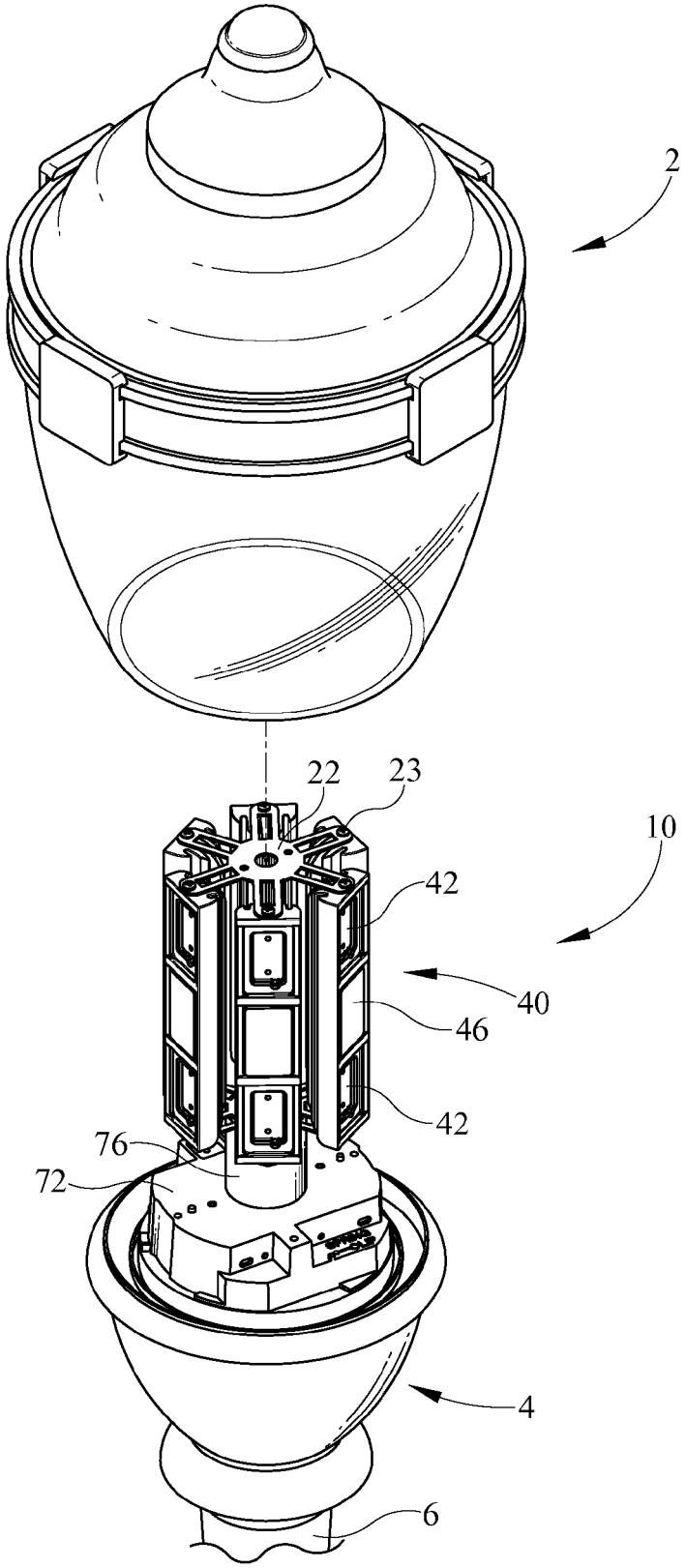
FIG. 1 is a top perspective view showing a first embodiment of a LED unit installed in a post-top luminaire, with a globe of the post-top luminaire exploded away.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now to the Figures, wherein like numerals refer to like parts, and in particular to FIG. 1 through FIG. 5 where a first embodiment of an LED unit 10 is shown. In FIG. 1 LED unit 10 is shown installed in a post-top luminaire. The post-top luminaire includes a support base or pole 6 which is coupled to and supports a fitter 4. The fitter 4 supports a globe 2, shown in FIG. 1 exploded away from fitter 4. The globe 2 may be sealably retained by fitter 4, forming an optical chamber substantially sealed from the external environment. Globe 2 may be designed to help achieve a given light distribution pattern and may be provided with a refractive surface, prismatic surface, and/or reflectors, among other items, if desired for a particular light distribution. The post-top luminaire of FIG. 1 is provided for exemplary purposes and as made apparent from the present description, LED unit 10 may be used with or adapted for use with a variety of post-top luminaires having varied support, fitter, and/or globe configurations, among other things. For example, globe 2 may include a separable roof portion. The roof portion may be removably sealed to the globe and the globe may be removably or fixedly sealed to the fitter 4.

LED unit 10 has an LED driver cover 72 that may be removably affixed to the fitter 4 and that may cover at least one LED driver 74. Six vertically oriented elongated LED panels 40 are disposed above the LED driver cover 72 and are arranged in a generally circular fashion about a central open region. The central open region may be used for wiring to make appropriate electrical connections to each LED panel 40 and/or may provide an area for more efficient cooling. Each LED panel 40 is disposed between a top portion 22 and a bottom portion 26 of a frame. Top portion 22 and bottom portion 26 each have a central hub with support structure or six spokes extending therefrom. Each LED panel 40 is held in place by screws 23 that are inserted through apertures in support structure of top portion 22 and bottom portion 26 of the frame and received in a corresponding receptacle 41 of each LED panel 40. The screws 23 associated with any one LED panel 40 may be loosened to allow for rotational movement of each LED panel 40 about a vertical panel axis. The screws 23 may also be tightened to fix each LED panel 40 at a given rotational orientation about its respective vertical panel axis.

Figure 2:
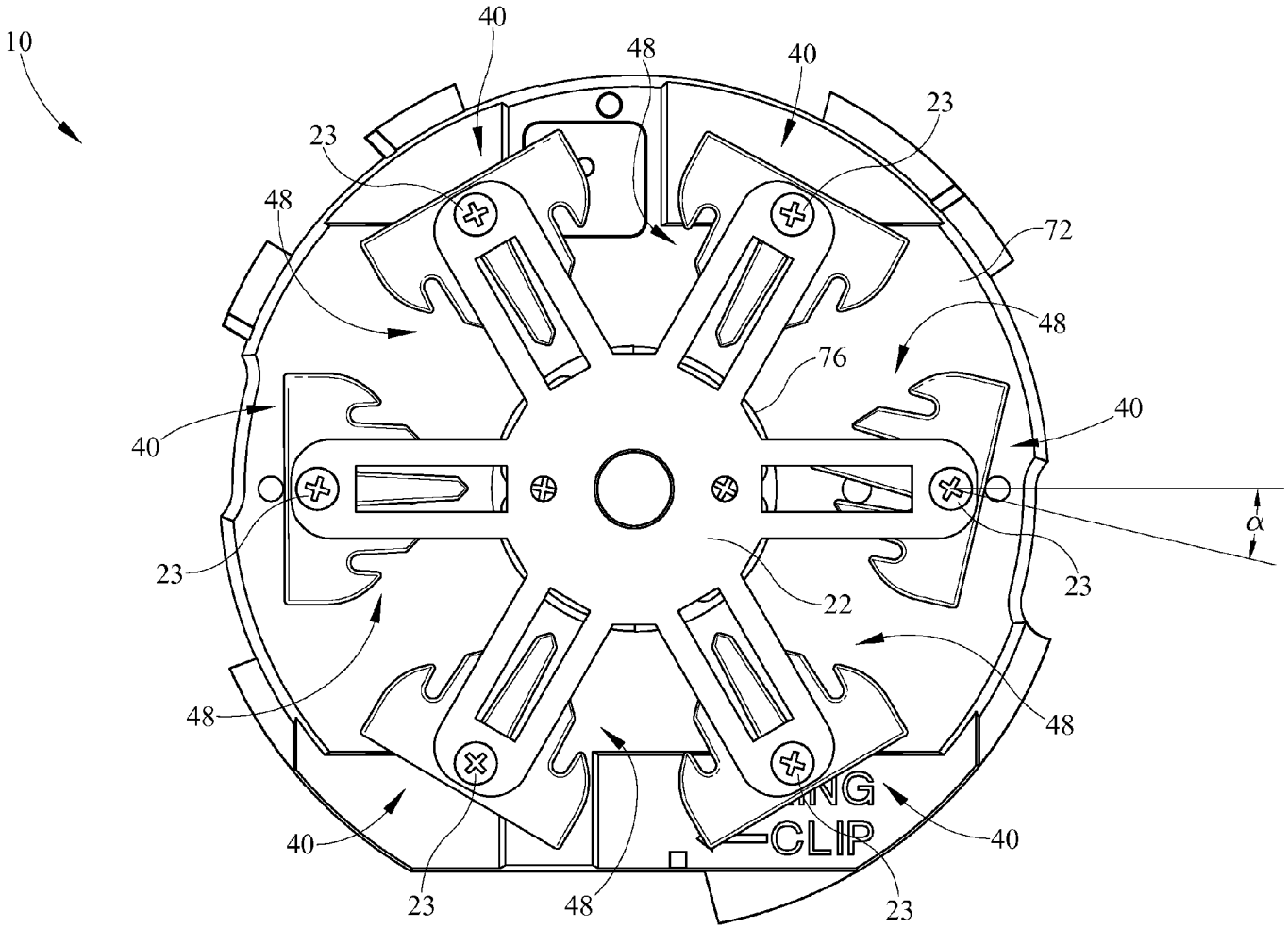
FIG. 2 is a top view of the LED unit of FIG. 1 showing a single LED panel individually rotated about its vertical panel axis.
Figure 4:
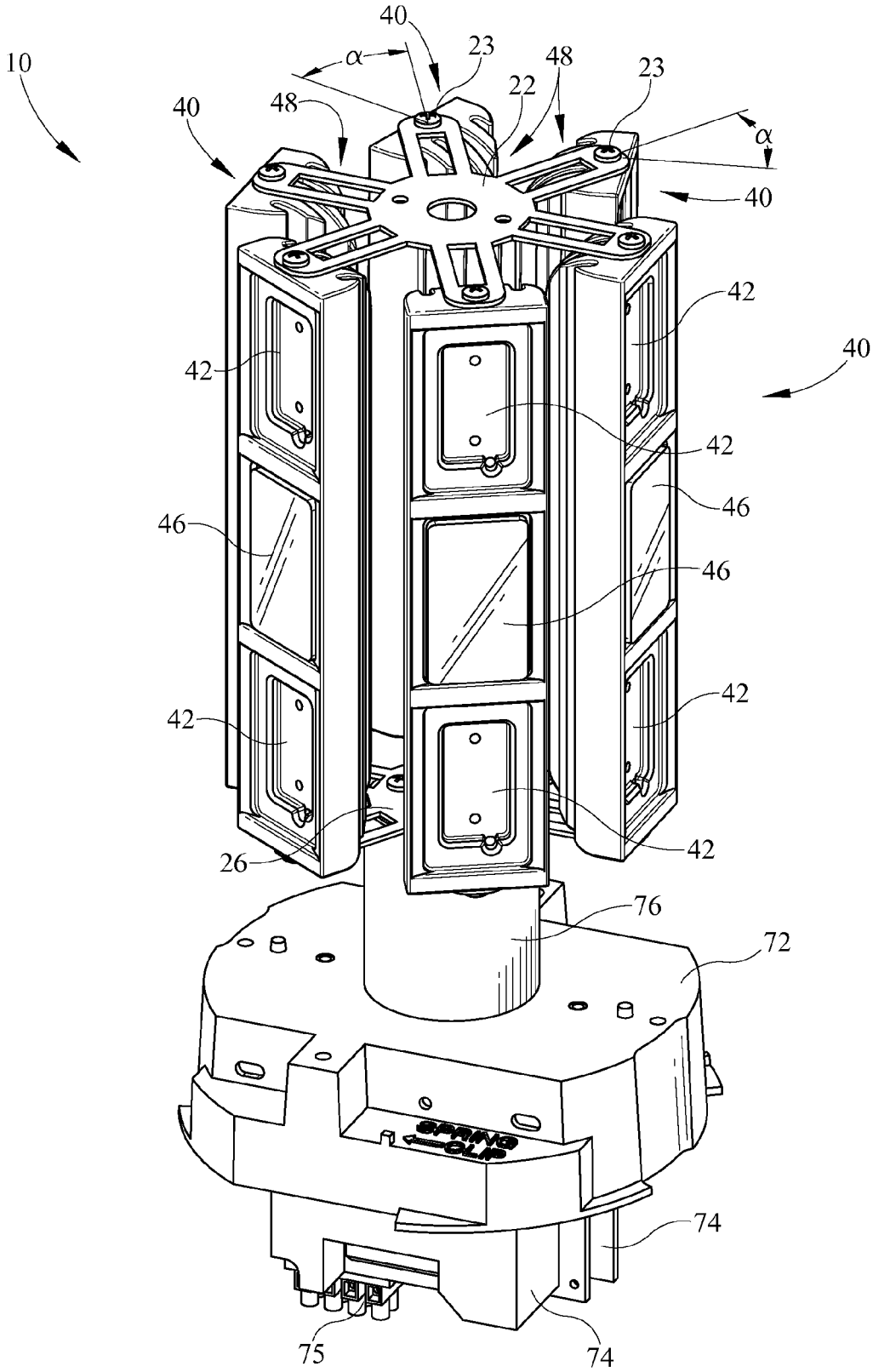
FIG. 4 is a perspective view of the LED unit of FIG. 1 showing two LED panels individually rotated about their respective vertical panel axes.

Exemplary rotation about a vertical panel axis is illustrated by the single LED panel 40 in FIG. 2 that is rotated approximately five degrees, as indicated by $\alpha$, about its vertical panel axis and by the pair of adjacent LED panels 40 in FIG. 4 that are rotated approximately forty-five degrees, as indicated by $\alpha$, in opposite directions about their respective vertical panel axis. Each LED panel 40 may be individually rotated about its vertical panel axis and fixed at a given rotational orientation, allowing for symmetric and asymmetric distribution patterns from LED unit 10 that may be selectively adjusted by a user as desired. Reflective shields may be used, but are not needed with LED unit 10, as rotatable LED panels 40 may be rotated to direct light away from a given area in order to achieve a desired asymmetric light distribution. LED unit 10 may be used in retrofit applications if desired and LED panels 40 may be appropriately rotated to replicate a previously existing distribution pattern, or create a new distribution pattern, while interfacing with the same preexisting globe of the post-top luminaire. In some embodiments LED unit 10 may be used to replace an incandescent light source or a metal halide light source.

Figure 5:
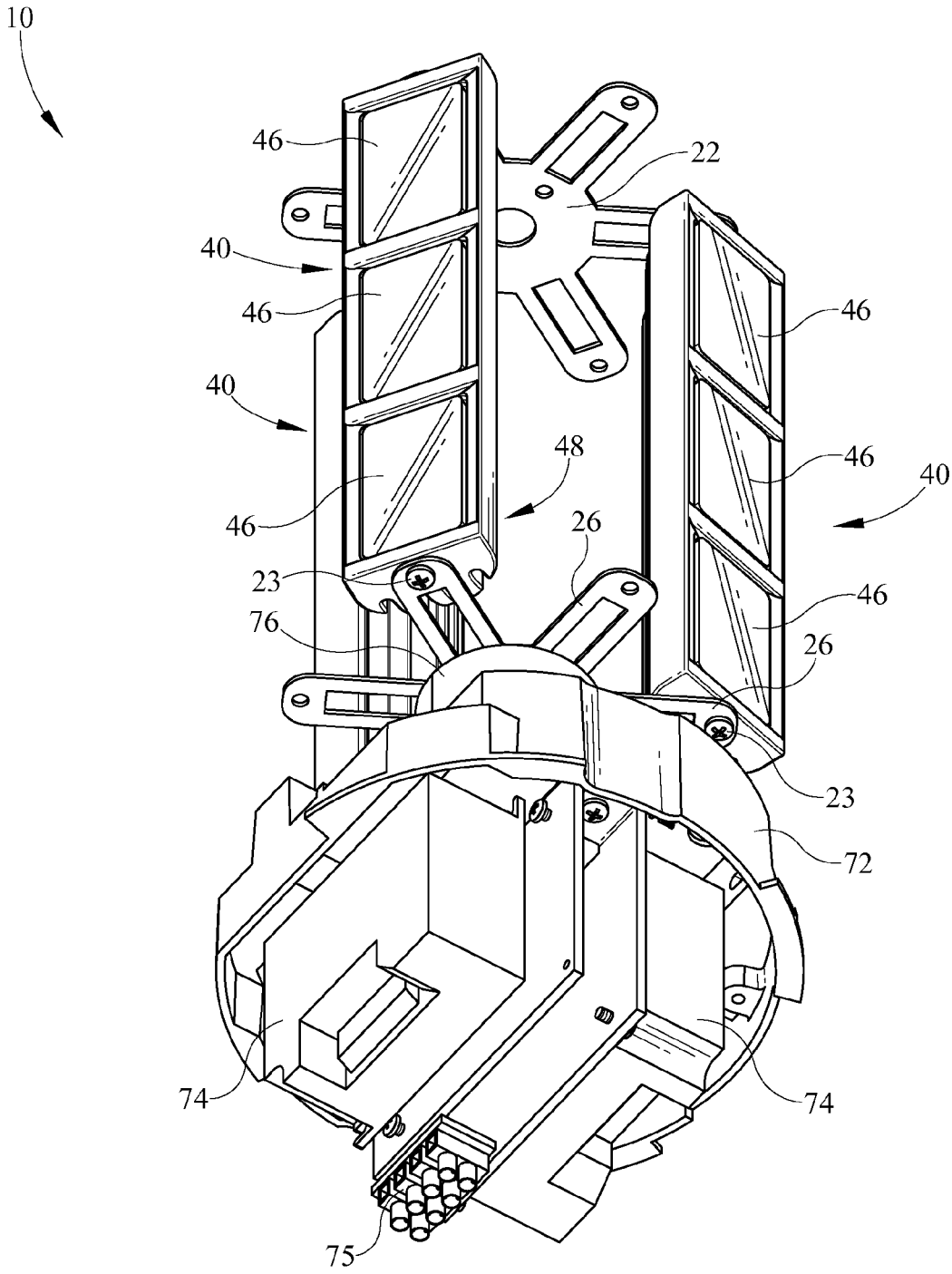
FIG. 5 is a perspective view of the LED unit of FIG. 1 with three of the six LED panels detached and removed from the LED unit.

Screws 23 associated with any one LED panel 40 may also be loosened and completely removed to allow for detachment of any LED panel 40. For example, as shown in FIG. 5, three LED panels 40 have been detached and removed from LED unit 10. One or more LED panels 40 may be removed to alter the distribution pattern and/or luminous intensity of LED unit 10 and may be removed by a user or at the factory. The ability to rotate each LED panel 40 about its respective vertical panel axis and to selectively detach and remove each LED panel provides an easily customizable LED unit 10 providing for flexibility in light distribution and luminosity. While a screw 23 engaging a corresponding receptacle 41 of each LED panel 40 has been described, one skilled in the art will recognize that other fasteners and other mechanical affixation methods may be used in some embodiments to rotatably and/or removably attach each LED panel 40 to top portion 22 and/or bottom portion 26 of the frame. For example, prongs and/or structure extending from top portion 22 and/or bottom portion 26 of the frame may interface with corresponding structure on LED panels 40. Also, this interchangeably includes fasteners and/or structure extending from LED panels 40 that correspond with structure on top portion 22 and/or bottom portion 26 of the frame. Also, although the frame of the first embodiment has been described as having both a top frame portion 22 and a bottom frame portion 26 with specific structure, one skilled in the art will recognize that other frame configurations may properly support LED panels 40, including frames that only have a bottom frame portion 26 or only have a top frame portion 22.

Figure 3:
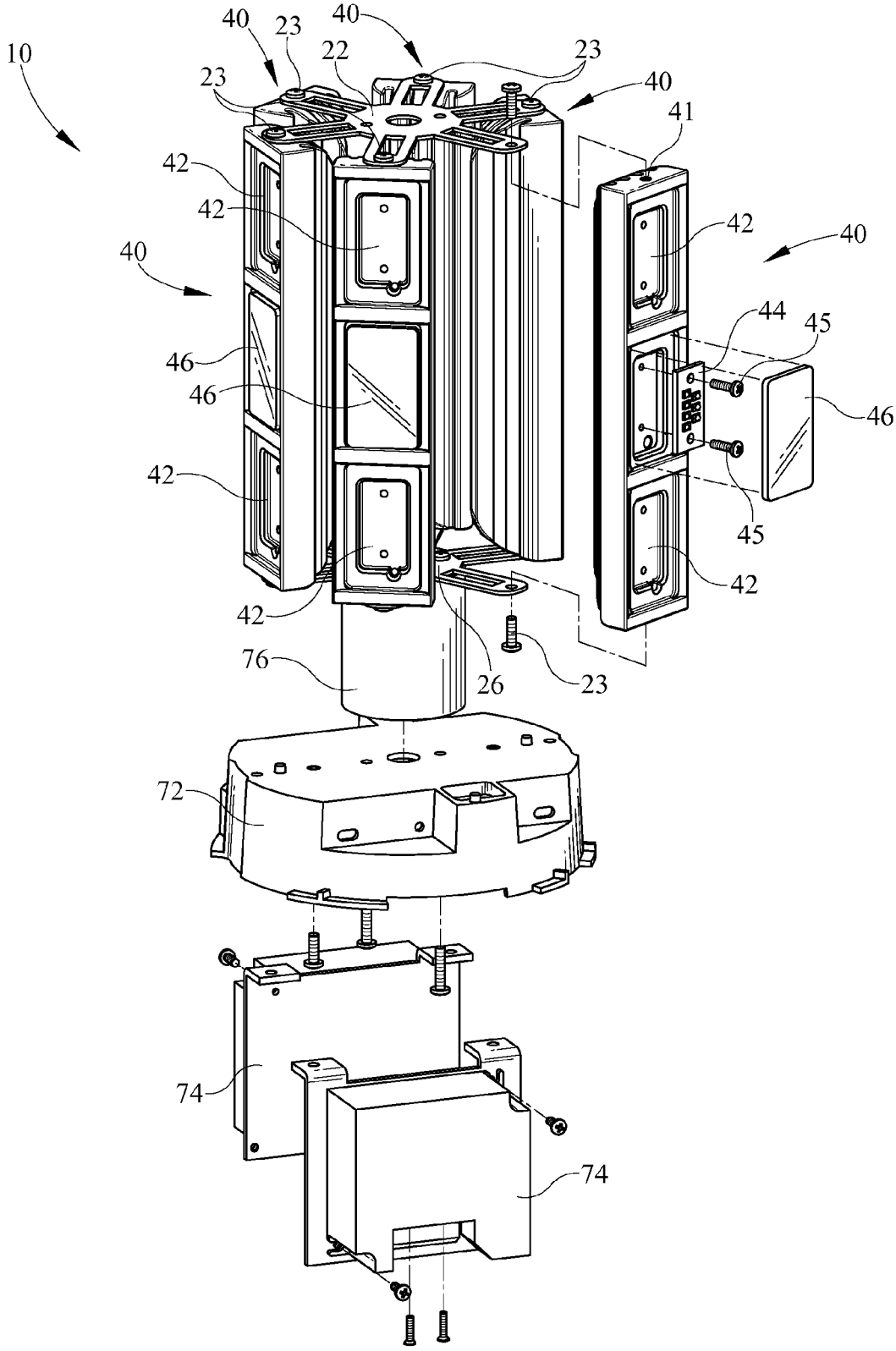
FIG. 3 is an exploded perspective view of the LED unit of FIG. 1.

Each LED panel 40 shown has a support surface with three recessed pockets 42. With particular reference to FIG. 3, at least one LED printed circuit board, such as LED printed circuit board 44, may be received in each recessed pocket 42 and secured in recessed pocket by, for example, screws 45. In some embodiments LED printed circuit board 44 may be a metal core circuit board and have seven or ten one-watt Luxeon Rebel LEDs coupled thereto. In alternative configurations differing numbers of LEDs may be used as well as printed circuit boards of differing material. A thermal interface material may optionally be interposed between LED printed circuit board 44 and the support surface of the LED panel 40. In some embodiments the thermal interface material may include a thermal pad such as an eGRAF HITHERM HT-1220 thermal pad manufactured GrafTech. In alternative configurations other thermal interface materials may optionally be used such as, but not limited to, thermal grease or thermal paste. A lens 46 may then be placed over LED printed circuit board 44 and seal each recessed pocket 42 in such a manner as to achieve appropriate ingress protection rating qualifications if desired. In some embodiments each lens 46 may be affixed using a high temperature silicone and achieve an ingress protection rating of IP 66. In some embodiments the high temperature silicone may be Dow Corning 733 Glass and Metal Sealant. Apertures may also be provided through portions of LED panel 40 to enable wiring to extend from LED driver 74 to any LED printed circuit board 44. Such apertures may likewise be sealed with high temperature silicone to achieve appropriate ingress rating qualifications.

As depicted in FIG. 1 through FIG. 4, less than all of recessed pockets 42 may be provided with a LED printed circuit board. This allows for a manufacturer and/or user to use the same LED panel 40 with a variable amount of LED printed circuit boards 44 in order to provide flexibility in luminous output and/or light distribution from LED unit 10. For example, as shown in FIGS. 1 through 4, only one recessed site 42 may be provided with a LED printed circuit board 44 and covered with a lens 46. Alternatively, as shown in FIG. 5, each recessed site 42 may be provided with a LED printed circuit board and covered with a lens 46, providing for a higher luminosity LED unit 10. In other embodiments of LED unit 10, a support surface for LEDs may be provided without recessed sites 42 or with a greater or lesser number of recessed sites 42, and/or with larger or smaller recessed sites 42 that may accommodate variable sized or variable numbers of printed circuit boards.

Extending rearward from each support surface of each LED panel 40 is a heatsink 48 having a plurality of variable height heat fins that extend rearward and away from the support surface of LED panel 40. In the depicted embodiments LED support surface and LED heatsink 48 are formed as an integral piece, which can be made, for example, by a casting from aluminum or an aluminum alloy such as a 356 Hadco Modified aluminum alloy. Heatsink 48 is in thermal connectivity with recessed sites 42 and any LED printed circuit boards 44 received by recessed sites 42 and helps dissipate heat generated by any LED printed circuit board 44.

A frame support base 76 may support bottom frame portion 26 and is coupled to LED driver cover 72, which covers a pair of LED drivers 74. In other embodiments only one LED driver, or more than two LED drivers may be provided. Frame support base 76 may be interchanged at the factory or by a user with a frame support base of a differing height to permit vertical adjustment of the LED panels 40 in order to appropriately position LED unit 10 within a globe of a particular post-top luminaire. The depicted LED driver cover 72 is a Twistlock ballast cover manufactured by Hadco from die cast aluminum and is designed to rotatably engage corresponding structure extending from the top of a fitter of a post-top luminaire and be locked in place with a spring clip. The depicted LED driver cover 72 and LED unit 10 provide for tool-less installation of LED unit 10. However, as understood in the art, other driver covers may be utilized to appropriately isolate LED drivers, such as LED drivers 74. LED drivers 74 may be placed in electrical communication with one another and contain a terminal block 75 for electrically coupling LED drivers 74 with power from a power source. In some embodiments LED drivers 74 may be one or more drivers manufactured by Advance, part number LED120A0024V10F.

Figure 6:
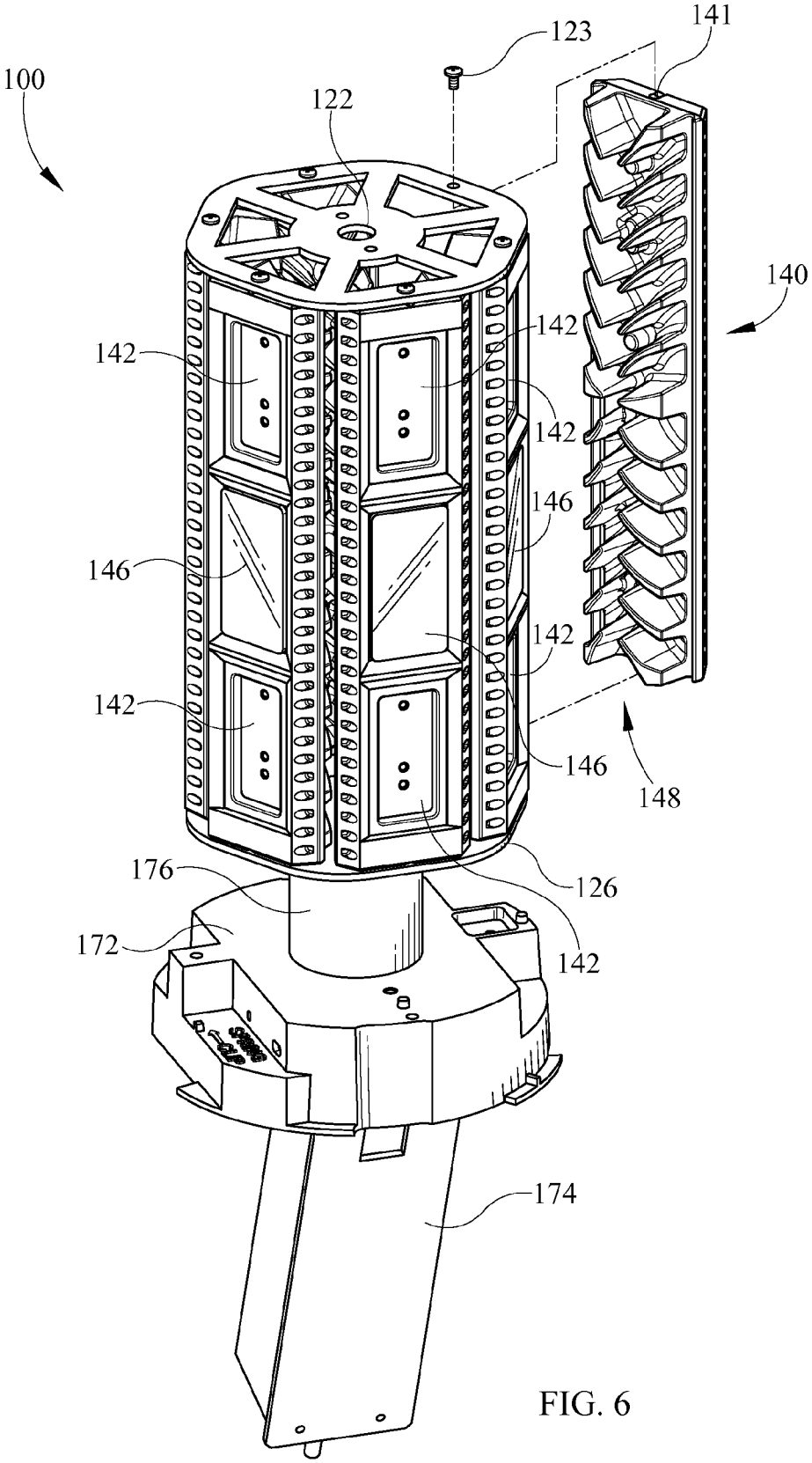
FIG. 6 is a top perspective view showing a second embodiment of a LED unit with an embodiment of an LED panel exploded away.

Referring now to FIG. 6, a second embodiment of an LED unit 100 has an LED driver cover 172 that covers an elongated single LED driver 174. Six vertically oriented LED panels 140 are disposed above the LED driver cover 172 and are arranged in a generally circular fashion about a central open region. The central open region may be used for wiring to make appropriate electrical connections to each LED panel 140 and/or may provide an area for more efficient cooling. Each LED panel 140 is disposed between a top portion 122 and a bottom portion 126 of a frame. Top portion 122 and bottom portion 126 each have a central hub with support structure or six interconnected spokes extending therefrom.

Each LED panel 140 is held in place by screws 123 that are each inserted through an aperture in part of the support structure interconnecting each spoke of top portion 122 and bottom portion 126 of the frame and received in a receptacle 141 of each LED panel 140. The screws 123 associated with any one LED panel 140 may be loosened to allow for rotational movement of each LED panel 140 about a vertical panel axis. The screws 123 may also be tightened to fix each LED panel 140 at a given rotational orientation about its respective vertical panel axis. Screws 123 associated with any one LED panel 140 may also be loosened and completely removed to allow for detachment of any LED panel 140.

A frame support base 176 supports bottom frame portion 126 and is coupled to LED driver cover 172. Frame support base 176 may be interchanged at the factory or by a user with a frame support base of a differing height to permit vertical adjustment of the LED panels 140 in order to appropriately position LED unit 100 within a globe of a particular post-top luminaire. LED driver cover 172 is a twist lock ballast cover designed to tool-lessly rotatably engage corresponding structure extending from the top of a fitter of a post-top luminaire and be locked in place with a spring clip.

Each LED panel 140 has a support surface with three recessed pockets 142. At least one LED printed circuit board may be received and secured in each recessed pocket 142. A lens 146 may then be installed to seal each recessed pocket 142. Extending rearward from each support surface of each LED panel 140 is a heatsink 148 having a plurality of arcuate heat fins in thermal connectivity with a support surface having recessed sites 142 and any LED printed circuit boards received by recessed sites 142 and helps dissipate heat generated by the LEDs of the LED printed circuit board.

Figure 7:
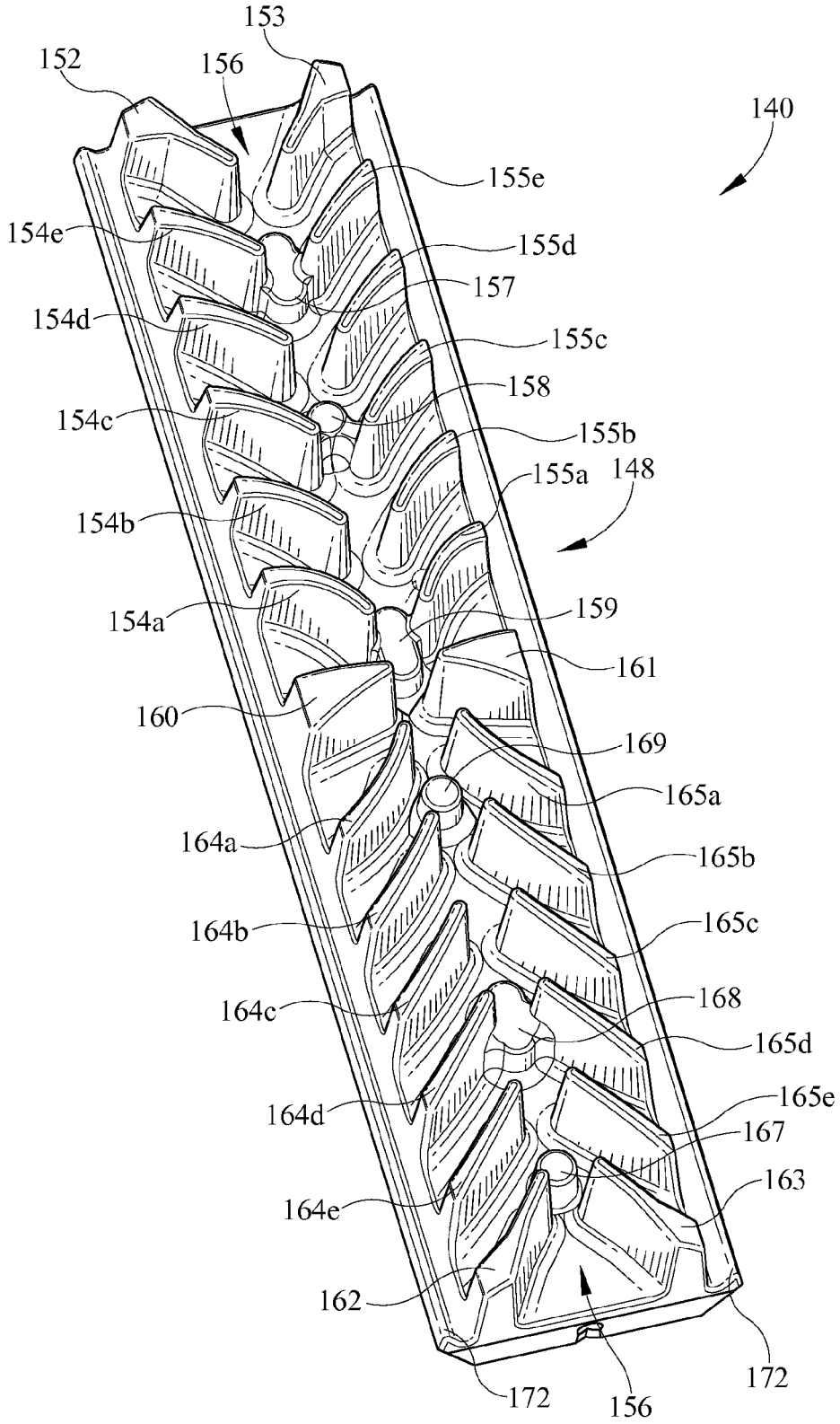
FIG. 7 is a perspective view of a heatsink of the LED panel of the LED unit of FIG. 6.
Figure 8:
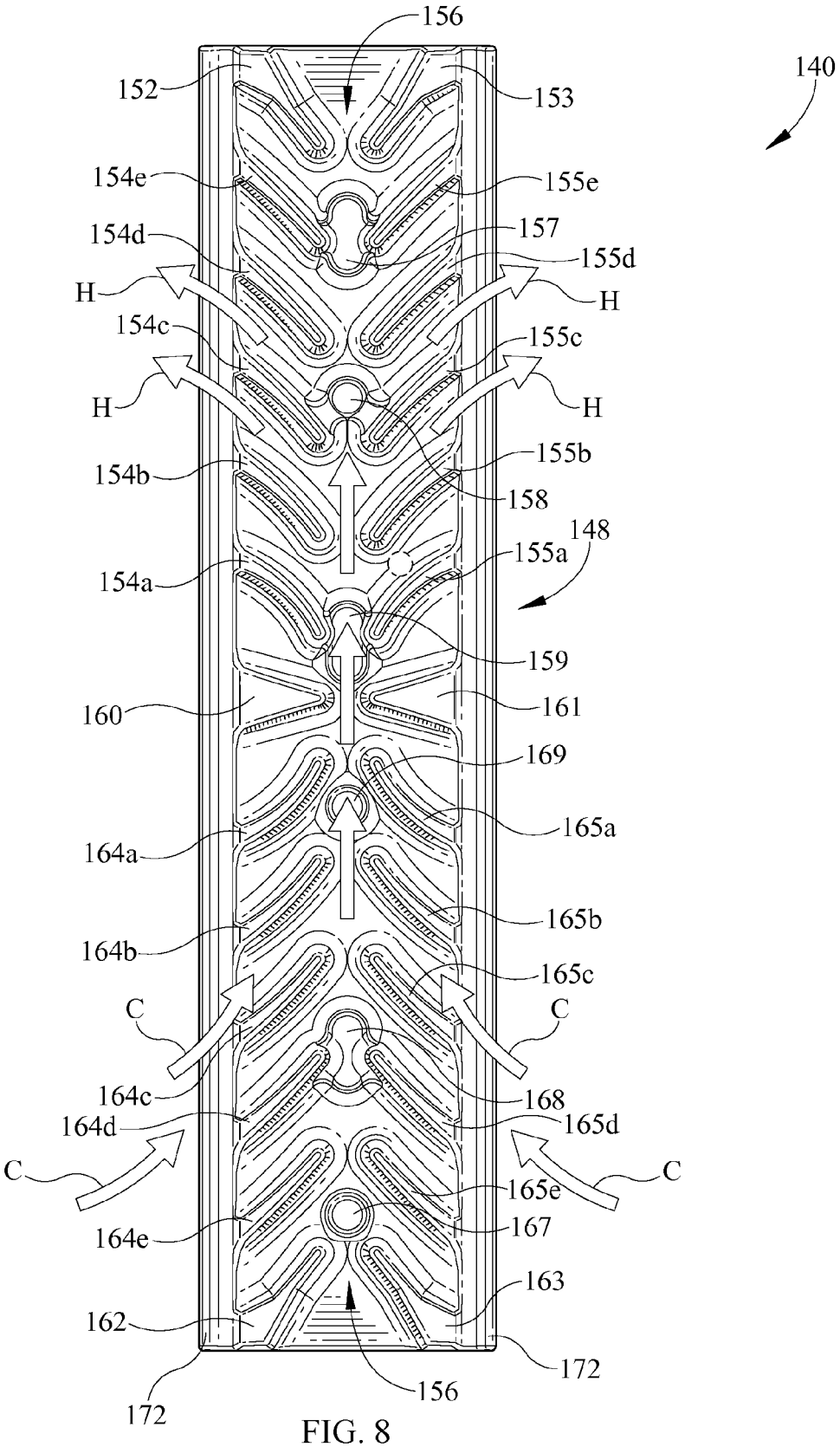
FIG. 8 is a top view of the heatsink of FIG. 7.

Referring now to FIG. 7 and FIG. 8, the depicted embodiment of heatsink 148 is described in more detail. Heatsink 148 has a plurality of arcuate heat fins 154*a-e*, 155*a-e*, 164*a-e*, and 165*a-e* flanking each side of a channel 156 that extends longitudinally along the entire length of heatsink 148. In some embodiments LED heatsink 148 may be sand casted from an aluminum alloy such as a 356 Hadco Modified aluminum alloy. In the depicted embodiment channel 156 is centrally aligned and includes bosses 157, 158, 159, 167, 168, and 169 that extend partially into channel 156. Bosses 157, 158, 159, 167, 168, and 169 may receive corresponding screws or other fasteners that are used to secure printed circuit boards within recessed sites 142. Fasteners that are used to secure printed circuit boards within recessed sites 142 may also or alternatively be received in bosses that are completely or partially within any or all of arcuate heat fins 154*a-e*, 155*a-e*, 164*a-e*, and 165*a-e*.

The arcuate heat fins 154*a-e*, 155*a-e*, 164*a-e*, and 165*a-e* extend from proximal central channel 156 toward the longitudinal periphery of heatsink 148 and are oriented to efficiently dissipate heat from heatsink 148 when heatsink 148 is oriented vertically, horizontally, or at an angle between horizontal and vertical. Each arcuate heat fin 154*a-e*, 155*a-e*, 164*a-e*, and 165*a-e* has a first end located proximal central channel 156 and a second end located proximal a trough adjacent a ridge 172 that extends longitudinally proximal the longitudinal periphery of the heatsink 148.

Heatsink 148 may be divided latitudinally into a first portion and a second portion in some embodiments. In the depicted embodiment pie shaped heat fins 160 and 161 divide heatsink 148 into a first and second portion and define a latitudinal dividing region. Each arcuate heat fin 154*a-e*, 155*a-e*, 164*a-e*, and 165*a-e* is oriented such that the interior face of each arcuate heat fin 154*a-e*, 155*a-e*, 164*a-e*, and 165*a-e* generally faces toward the dividing region generally defined by pie shaped heat fins 160 and 161 and generally faces away from channel 156. Also, the second end of each arcuate heat fin 154*a-e*, 155*a-e*, 164*a-e*, and 165*a-e* is more distal the dividing region and channel 156 than the first end of each arcuate heat fin and the exterior face of each arcuate heat fin generally faces toward channel 156. As a result of the shape and orientation of the heat fins, the amount of heat that becomes trapped in between the heat fins and reabsorbed is reduced.

When oriented in a non-horizontal direction, heat dissipation is further optimized by heatsink 148 as a result of natural convection. For example, assuming heat fins 152 and 153 are located at a higher vertical position than heat fins 162 and 163, hot air, exemplarily designated by Arrows H in FIG. 8, is forced outward and away from heatsink 148. Cooling air, exemplarily designated by Arrows C in FIG. 8, is drawn toward the heatsink from the surrounding environment. Central channel 156 provides a path for communication of air between heat fins, exemplarily designated by the unlabeled arrows extending through central channel 156, and further aids in heat removal and natural convection. The shape and orientation of the heat fins in the depicted embodiment aids natural convection by forcing heat outward and away from heatsink 148 while drawing in cooling air and reduces reabsorption of heat by the heat fins of heatsink 148. The shape of the heat fins also provides additional surface area for improved convection. In some embodiments an apparatus such as a fan may be used in conjunction with heatsink 148 for forced convection.

In the depicted embodiment of heatsink 148 each arcuate heat fin 154*a-e*, 155*a-e*, 164*a-e*, and 165*a-e* is a curved segment of a circle and has a corresponding arcuate heat fin that also forms a curved segment of the same circle. Also, in the depicted embodiment each arcuate heat fin 154*a-e*, 155*a-e*, 164*a-e*, and 165*a-e* has a mirror imaged heat fin located on the opposite side of channel 156 that also has a corresponding arcuate heat fin that also forms a segment of the same circle. For example, arcuate heat fins 155*a* and 165*a* form a segment of the same circle and may generally circulate air between one another, potentially increasing the convective current. Opposite arcuate heat fins 155*a* and 165*a* are arcuate heat fins 154*a* and 164*a*, which form a segment of a circle that is the same radius of the segment of the circle formed by arcuate heat fins 155*a* and 165*a*. Also, arcuate heat fins 155*e* and 165*e* form a segment of the same circle, which is much larger than the circle partially formed by arcuate heat fins 155*a* and 165*a*. In other words, arcuate heat fins 155*e* and 165*e* have a more gradual curvature than arcuate heat fins 155*a* and 165*a*.

In the depicted embodiment of heatsink 148, the curvature of heat fins 154*a-e*, 155*a-e*, 164*a-e*, and 165*a-e* becomes more gradual the farther away from pie shaped heat fins 160 and 161 it is located, such that each heat fin progressively forms a segment of a larger circle. Heat fins 152, 153, 162, and 163 are not segments of a circle, but do aid in the convective process and help dissipate heat away from, and draw cooling air into, heatsink 148. Also, although the interior facing portion of arcuate heat fins 152, 153, 162, and 163 is formed from two nearly linear portions, it still has a generally arcuate overall shape. Extending along the longitudinal peripheries of heatsink 148 is a ridge portion 172, which sits atop a trough and may be provided for additional surface area for dissipation of heat.

Although heatsink 148 has been illustrated and described in detail, it should not be limited to the precise forms disclosed and obviously many modifications and variations to heatsink 148 are possible in light of the teachings herein. For example, in some embodiments some or all arcuate heat fins may not form a segment of a circle, but may instead be otherwise arcuate. Also, for example, in some embodiments some or all arcuate heat fins may not be provided with a corresponding mirror imaged heat fin on an opposite side of a channel and/or an opposite side of a dividing region. Also, for example, in some embodiments where a dividing region is present, the dividing region may not have any heat fins such as pie shaped heat fins 160 and 161. Also, for example, in some embodiments heat fins may have one or more faces formed from multiple linear segments and still be generally arcuate in shape. Although certain forms of the heatsink 148 have been illustrated and described, it is not limited thereto except insofar as such limitations are included in the following claims and allowable functional equivalents thereof. Also, although heatsink 148 has been described in conjunction with a LED unit 100, one skilled in the art will readily recognize its uses are not limited to such.

The foregoing description has been presented for purposes of illustration. It is not intended to be exhaustive or to limit the invention to the precise forms disclosed, and obviously many modifications and variations are possible in light of the above teaching. It is understood that while certain forms of the invention have been illustrated and described, it is not limited thereto except insofar as such limitations are included in the following claims and allowable functional equivalents thereof.

I claim:

1. An elongated LED panel for supporting and cooling at least one LED, said elongated LED panel comprising:

an elongated support surface supporting at least one LED;

an elongated heatsink extending rearward and away from said support surface, said heatsink having a longitudinally extending channel flanked on each side by a longitudinally extending column of heat fins having an inner at least partially arcuate face and an outer at least partially arcuate face that respectively form an inside and outside segment of a common circle;

wherein each said outer at least partially arcuate face generally faces toward said central channel; and wherein each said inner at least partially arcuate face generally faces away from said central channel and toward a longitudinal periphery of said heatsink.

2. The elongated LED panel of claim 1, wherein at least one of said heat fins has a mirror imaged corresponding single of said heat fins on an opposite side of said channel.

3. The elongated LED panel of claim 2, wherein two of said plurality of heat fins in a single said longitudinally extending column are mirror images of one another.

4. The elongated LED panel of claim 2, wherein said inner at least partially arcuate faces of two of said plurality of said heat fins in a single said longitudinally extending column form the segment of a common circle.

5. The elongated LED panel of claim 1, wherein each said support surface has at least one recessed pocket receiving at least one LED printed circuit board.

6. The elongated LED panel of claim 5, wherein said at least one recessed pocket receiving at least one LED printed circuit board is sealed with a lens.

7. The elongated LED panel of claim 6, wherein said channel is centrally aligned on said heatsink.

8. The elongated LED panel of claim 7, wherein a longitudinally extending trough and corresponding ridge extend proximal each longitudinal edge of said heatsink.

9. An elongated LED panel for supporting and cooling at least one LED, said elongated LED panel comprising:

a front and rear surface, said front surface having an elongated support surface supporting at least one LED;

a heatsink extending rearward and away from said support surface and on said rear surface, said heatsink having a longitudinally extending channel flanked on each side by a longitudinally extending column of heat fins having an inner at least partially arcuate face and an outer at least partially arcuate face that respectively form an inside and outside segment of a common circle;

wherein each said outer at least partially arcuate face generally faces toward said central channel; and wherein each said inner at least partially arcuate face generally faces away from said central channel and toward a longitudinal periphery of said heatsink;

said LED panel rotatably mounted on a first side to a frame top and rotatably mounted on a second side to a frame bottom, said frame top and said frame bottom affixed to a frame support base.

10. An elongated LED support panel for use in an LED post-top luminaire, comprising:

a front and rear surface of said support panel, said front surface having an elongated support surface having a plurality of recesses, each of said recesses supporting at least one LED;

wherein each of said recesses of said front surface having a lens fitted over said at least one LED;

a heatsink extending rearward and away from said rear surface of said support panel, said heatsink having a longitudinally extending channel flanked on each side by a longitudinally extending column of heat fins having an inner at least partially arcuate face and an outer at least partially arcuate face that respectively form an inside and outside segment of a common circle;

wherein each said outer at least partially arcuate face generally faces toward said central channel; and wherein each said inner at least partially arcuate face generally faces away from said central channel and toward a longitudinal periphery of said heatsink;

said LED support panel rotatably mounted to a frame affixed to a frame support base.

* * * * *